US008878442B2

(12) United States Patent
Lu et al.

(10) Patent No.: US 8,878,442 B2
(45) Date of Patent: Nov. 4, 2014

(54) CHANDELIER LAMP SYSTEM

(75) Inventors: Sun Lu, Mt. Hamilton, CA (US); Wen-Chau Wayne Hou, Cupertino, CA (US)

(73) Assignees: Sun Lu, Mt. Hamilton, CA (US); Wen-Chau Wayne Hou, Cupertino, CA (US)

( * ) Notice: Subject to any disclaimer, the term of this patent is extended or adjusted under 35 U.S.C. 154(b) by 528 days.

(21) Appl. No.: 13/219,885

(22) Filed: Aug. 29, 2011

(65) Prior Publication Data

US 2012/0049765 A1 Mar. 1, 2012

Related U.S. Application Data

(60) Provisional application No. 61/378,840, filed on Aug. 31, 2010.

(51) Int. Cl.

| | |
|---|---|
| ***H05B 37/00*** | (2006.01) |
| ***H01K 1/30*** | (2006.01) |
| ***H05B 33/08*** | (2006.01) |
| ***H05B 37/02*** | (2006.01) |
| ***F21S 6/00*** | (2006.01) |
| ***F21S 10/04*** | (2006.01) |
| *F21S 8/06* | (2006.01) |

(52) U.S. Cl.

CPC ..... *H05B 33/0857* (2013.01); *H05B 37/0272* (2013.01); *F21S 8/065* (2013.01); *F21S 6/001* (2013.01); *H05B 37/029* (2013.01); *F21S 10/04* (2013.01)

USPC ..... 315/185 R; 315/312; 313/110

(58) Field of Classification Search

CPC ..... F21S 10/04; F21S 6/001; F21S 8/065; F21V 35/00; F21V 9/00; H05B 37/02; H05B 37/0272; H05B 37/029; H05B 33/0857; H01K 1/30

USPC ..... 315/185 R, 291, 307, 308, 312; 313/110, 116, 317

See application file for complete search history.

(56) References Cited

U.S. PATENT DOCUMENTS

| | | | | |
|---|---|---|---|---|
| 2008/0030441 | A1 * | 2/2008 | Callahan | 345/82 |
| 2010/0001662 | A1 * | 1/2010 | Nelkin et al. | 315/294 |

* cited by examiner

*Primary Examiner* — Jimmy Vu

(74) *Attorney, Agent, or Firm* — Jingming Cai; Schein & Cai LLP

(57) ABSTRACT

A method includes providing a chandelier comprising at least three light emitting diodes, with each of the at least three light emitting diodes having at least one color of red, green, and blue colors. The method also includes operatively connecting the light emitting diode to a controller and a memory such that the controller provides control instructions to the light emitting diodes. The method also has controlling the at least three light emitting diodes to provide a decorative lighting effect.

29 Claims, 11 Drawing Sheets

CHANDELIER LAMP SYSTEM

CROSS REFERENCE TO RELATED PATENT APPLICATIONS

This patent application claims priority to U.S. Provisional Patent Application No. 61/378,840 to Lu filed on Aug. 31, 2010 , which is incorporated by reference in its entirety.

FIELD OF THE INVENTION

The present disclosure is directed to an improved and energy efficient lamp system that mimics a traditional chandelier. More particularly, the present disclosure is directed to a chandelier that includes a number of light emitting diodes in different colors in a bulb envelope being controlled by a controller.

BACKGROUND OF THE RELATED ART

Chandelier lamps are very popular in homes and commercial places for decorative effects. An example of two chandelier lamps are shown as prior art in FIGS. 1 and 8 as reference letters A and B. Conventional chandelier lamps are traditionally hung from a ceiling or the like and use special shaped tungsten light bulbs with some cylindrical shaped stands below to mimic the candle lights. The tungsten filament inside the bulb is in a shape to mimic the flame of a candle light. With the glass crystals around, the modern chandelier lamps can create the same sparkling and romantic feelings of the beautiful candle lights in royal palaces and luxury homes for centuries.

Chandelier light bulbs are mostly available in 25 Watts and 40 Watts. Typical luminous efficiency is less than 15 Lumens per Watt. By today's standard, these are extremely inefficient light bulbs. That makes the chandelier lamps the most inefficient light fixtures in use today. However, they provide the unique decorative effects that can not be matched by any other light fixtures. This makes the chandelier lamps very popular all around the world.

In order to improve the energy efficiency of the chandelier lamps, a new chandelier light bulb based on compact fluorescent lamp technology was introduced to the market recently. A picture of this fluorescent prior art chandelier light bulb C is shown in FIG. 2.

In 2009, the European Union banned the commercial sales of tungsten filament light bulbs. That makes the compact fluorescent chandelier light bulb the only widely available alternative to replace the traditional chandelier bulbs. Other countries will likely follow suit. However, the fluorescent chandelier light bulbs do not provide the unique features of the traditional chandelier light bulbs.

First, the bulb has a wide spiral shaped fluorescent tube inside. As a result, the bulb requires a plastic envelop that is significantly larger than the traditional chandelier light bulbs. Second, in order to hide the spiral fluorescent tube, the molded plastic envelope has a flossy finish. This finish is very detrimental and does not give the sparkling feeling of the tungsten chandelier light bulb. Third, most of these fluorescent chandelier light bulbs run at 4 Watts. Even with the high efficiency of the fluorescent lamps, it emits only 195 Lumens. This is significantly less than the 300-600 Lumens emitted by the traditional tungsten chandelier light bulbs. Therefore, the light can appear to be dim to people used to using the prior bulbs and it is difficult to add bulbs to a lamp. Fourth, it is difficult to dim the fluorescent lamps to create the romantic and traditional decorative effect. With these issues, the fluorescent chandelier light bulb, even it is 400% more energy efficient, is not a good replacement of the tungsten chandelier light bulbs.

The light generating efficiency of LEDs commonly exceeds 60 Lumens/Watt. This is even more efficient than the compact fluorescent light bulbs. With LEDs, it is easy to have chandelier light bulbs that are 4 to 5 times more efficient than the tungsten filament chandelier light bulbs.

Currently, there is no large commercial distribution of chandelier light bulbs using light emitting diodes "LEDs". The fundamental reason is perhaps that an LED light bulb with 300-600 Lumens light output is still very expensive today. Also, in order to replace the tungsten chandelier light bulb, the LED light bulb has to run on AC voltage available at home. Therefore, it requires a special driving circuit inside each light bulb.

SUMMARY OF THE INVENTION

According to a first aspect of the present disclosure, there is provided a method. The method includes providing a chandelier comprising at least three light emitting diodes, with each of the at least three light emitting diodes having at least one color of red, green, and blue colors. The method also includes operatively connecting the light emitting diode to a controller and a memory such that the controller provides control instructions to the light emitting diodes. The method also has controlling the at least three light emitting diodes to provide a decorative lighting effect.

In yet another aspect of the present disclosure there is provided a chandelier bulb. The chandelier bulb has at least three light emitting diodes, with each of the at least three light emitting diodes having at least one color of red, green, and blue colors. The chandelier bulb has an envelope for containing the light emitting diodes and a driving circuit being connected to the light emitting diodes for driving the light emitting diodes. The bulb also has an optical component disposed in the envelope.

In another embodiment of the present disclosure, there is provided a chandelier comprising a power supply and a controller operatively connected to a memory. The chandelier also has at least one bulb comprising at least three light emitting diodes disposed in the bulb, with each of the at least three light emitting diodes having at least one color of red, green, and blue colors. The bulb also has an envelope for containing the light emitting diodes. The chandelier further has a driving circuit being connected to the light emitting diodes for driving the light emitting diodes and an optical component disposed in the envelope.

According to yet another embodiment of the present disclosure there is provided a chandelier that has a power supply and a converter for converting AC power to DC power. The chandelier further has a controller operatively connected to a memory and at least one bulb comprising at least three light emitting diodes disposed in the bulb, with each of the at least three light emitting diodes having at least one color of red, green, and blue colors. The bulb also has an envelope for containing the light emitting diodes. Chandelier also has a plurality of driving circuits for at least one driving circuit for each bulb. Each driving circuit is connected to the light emitting diodes for driving the light emitting diodes. The bulb also has an optical component disposed in the envelope.

According to yet another embodiment of the present disclosure there is provided a chandelier that has a power supply and a converter for converting AC power to DC power. The chandelier also has a controller operatively connected to a memory and at least one bulb comprising at least three light emitting diodes disposed in the bulb, with each of the at least three light emitting diodes having at least one color of red, green, and blue colors. The bulb also has an envelope for containing the light emitting diodes.

The chandelier further has a driving circuit, which is connected to each of the plurality of light emitting diodes and is for driving the light emitting diodes. The bulb also has an optical component disposed in the envelope. The chandelier further has a data interface connected to the controller and the driving circuit. The data interface, the controller, the memory, and the driving circuit are connected in a housing disposed in the chandelier.

According to yet a further embodiment of the present disclosure there is provided a chandelier that has a power supply and a converter for converting AC power to DC power. The chandelier also has a controller operatively connected to a memory and at least one bulb comprising at least three light emitting diodes disposed in the bulb with each of the at least three light emitting diodes having at least one color of red, green, and blue colors.

The bulb further has an envelope for containing the light emitting diodes. The chandelier further has a driving circuit being connected to each of the plurality of light emitting diodes for driving the light emitting diodes and an optical component disposed in the envelope. The chandelier also includes a data interface connected to the controller and the driving circuit. The data interface and the driving circuit are connected in a housing integrated within the at least one bulb.

According to yet a further embodiment of the present disclosure there is provided a chandelier that has a power supply and a converter for converting AC power to DC power. The chandelier also has a controller operatively connected to a memory and at least one bulb comprising at least three light emitting diodes disposed in the bulb with each of the at least three light emitting diodes having at least one color of red, green, and blue colors. The chandelier also has an envelope for containing the light emitting diodes and a driving circuit for driving the light emitting diodes. The chandelier further has an optical component disposed in the envelope. The chandelier further has a data interface being connected to the controller and the driving circuit. The data interface, the power converter and the driving circuit are connected in a housing.

According to yet another embodiment there is provided a method of retrofitting an existing chandelier with an energy efficient bulb. The method has the steps of replacing an energy inefficient bulb with an efficient bulb with the efficient bulb having a data interface being connected to a controller and a driving circuit, the data interface, a power converter, and the driving circuit being connected in a housing integrated within or adjacent to the at least one efficient bulb.

According to another aspect of the present disclosure, there is provided a chandelier lamp that can provide lighting with many different colors that can change according to some pre-programmed time sequences.

According to another aspect of the present disclosure, there is provided a chandelier lamp that has a number of light bulbs wherein the light bulbs of the chandelier use light emitting diodes that can emit light of at least three primary colors (Red, Green, and Blue). The intensity of the light of each primary color can be controlled independently by some pre-programmed time sequences.

According to another aspect of the present disclosure, there is provided a chandelier lamp that has a number of light emitting diodes that inside each light bulb (with the LEDs), there are some optical components (shapes) that are specially designed to reflect, diffuse, and bend the light from the LEDs to create the sparkling appearance that mimics the effects from the traditional chandelier light bulbs with tungsten filaments.

According to another aspect of the present disclosure, there is provided a chandelier lamp that can be retrofitted from an existing chandelier lamp that uses conventional bulbs and can be converted to using light bulbs with light emitting diodes.

According to another aspect of the present disclosure, there is provided a chandelier lamp that has at least one accessory device that can create and/or control the lighting effects of the chandelier. In one aspect, the chandelier comprises an audio sensing device wherein the light from the chandelier lamp (brightness and color) changes with the music, and the ways of the changing can be controlled by other accessory devices. The brightness and color may be set to change the lighting effects for rock & roll music, and the brightness and color may be set to change at a different rate for a waltz, etc.

According to another aspect of the present disclosure, there is provided a chandelier lamp that has at least one device for dissipating the heat generated by the light emitting diodes into the surrounding lamp structures.

BRIEF DESCRIPTION OF THE FIGURES

The foregoing and other objects, features and advantages of the invention will be apparent from the following more particular description of preferred embodiments of the invention, as illustrated in the accompanying drawings in which like reference characters refer to the same parts throughout different views. The drawings are not meant to limit the invention to particular mechanisms for carrying out the invention in practice, but rather, the drawings are illustrative of certain ways of performing the invention. Others will be readily apparent to those skilled in the art.

DETAILED DESCRIPTION OF THE PREFERRED EMBODIMENTS

This present disclosure is directed to an improved chandelier lamp system 100. The chandelier lamp system 100 has a traditional chandelier lamp appearance, but the system 100 also includes a control system and network architecture that can create one or more lighting effects that are aesthetically pleasing.

The chandelier lamp system 100 preferably includes at least three light emitting diodes with red, green, and blue (R, G, B) light emitting diodes. The R, G, B light emitting diodes in the light bulb are driven with three separate driving circuits which can control the brightness level of the emitted light from each color LED independently. Thus, the light emitted from the bulb is a mixture of R, G, B colors at various ratios and when combined can have many different colors.

The chandelier light bulb preferably has the red, green and blue light emitting diodes in a transparent envelope having the same shape as a traditional chandelier light bulb to preserve the decorative effect of the system 100. The system 100 may also include one or more lenses with designed optical shapes that can reflect, bent, and scatter the emitted light to create a sparkling appearance. In addition, the light emitting diode chandelier light bulb can have the LED driving circuit incorporated therein such that the bulbs can replace the traditional chandelier light bulbs. Alternatively, the LED driving circuits can be located in the chandelier to drive the LEDs in each light bulb through proper wiring.

The chandelier lamp system 100 also has a controller circuit with a processor, a memory, and one or more program instructions, or firmware that controls a brightness of the R, G, and B LEDs in the light bulbs according to a series of pre-set sequences specified by the program instructions. In addition, the system 100 may further include a circuit that interacts with various accessory devices outside the chandelier lamp.

The controller can control the LEDs with various preprogrammed lighting effects stored in its memory. The user can select, record, and preset a sequence of lighting effects with the accessory devices through various wired and wireless communication protocols. For example, one of the accessory devices is an audio sensing device that can communicate to the controller to control the light according to the music played in the MOM.

Figures 1, 8:
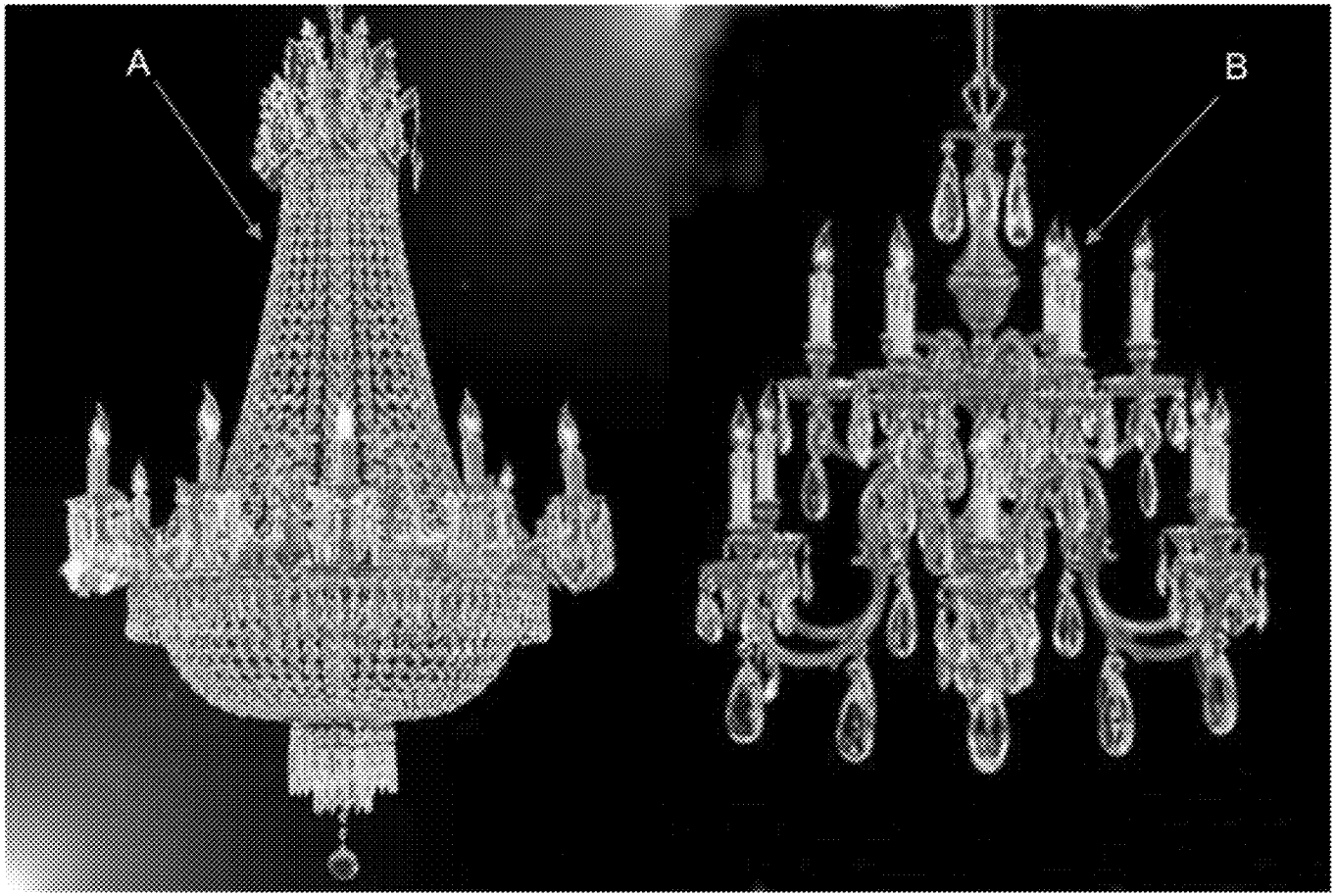
FIGS. 1 and 8 show a prior art configuration of two different prior art chandeliers.
Figure 2:
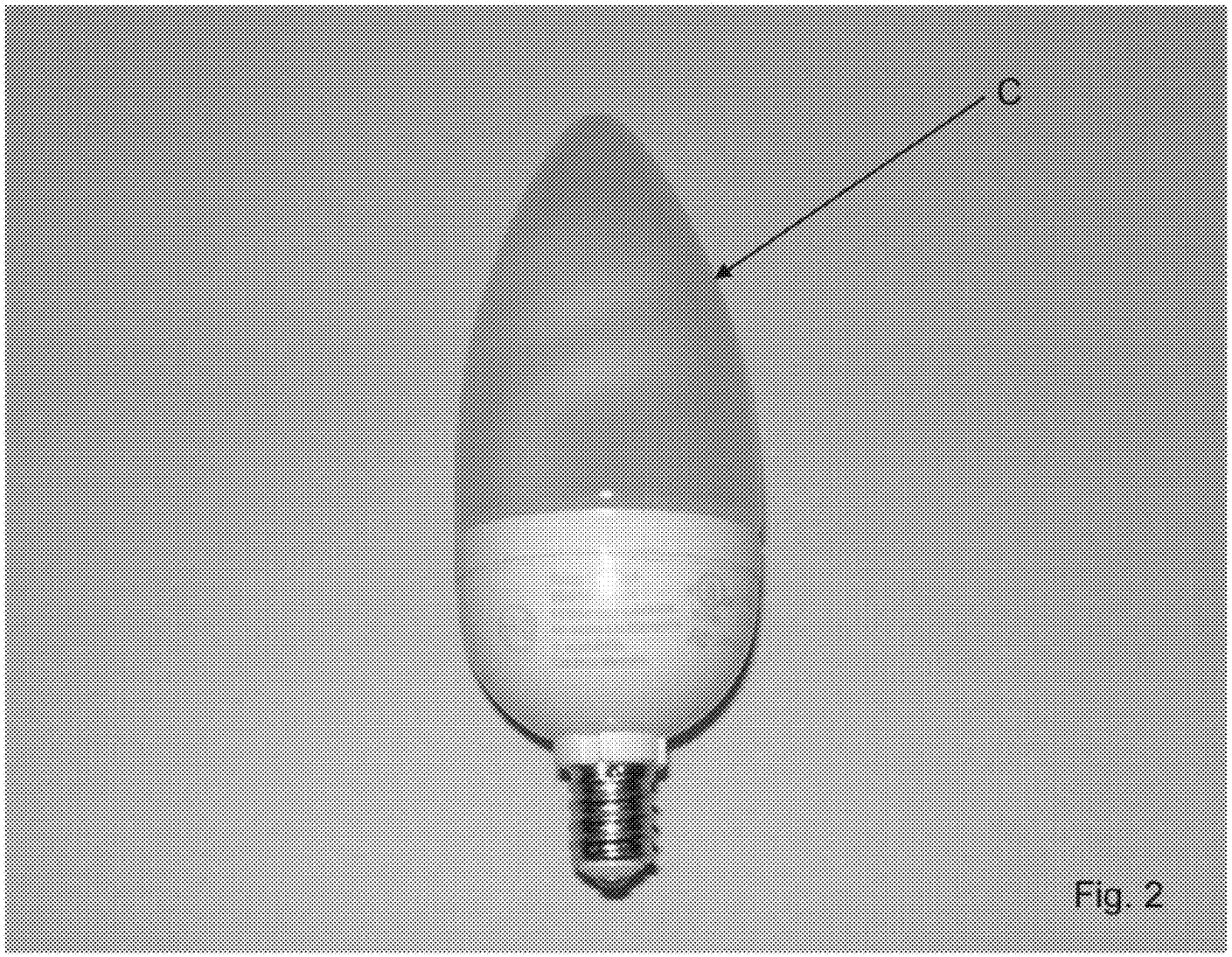
FIG. 2 shows a prior art bulb used with a prior art chandelier.
Figure 3:
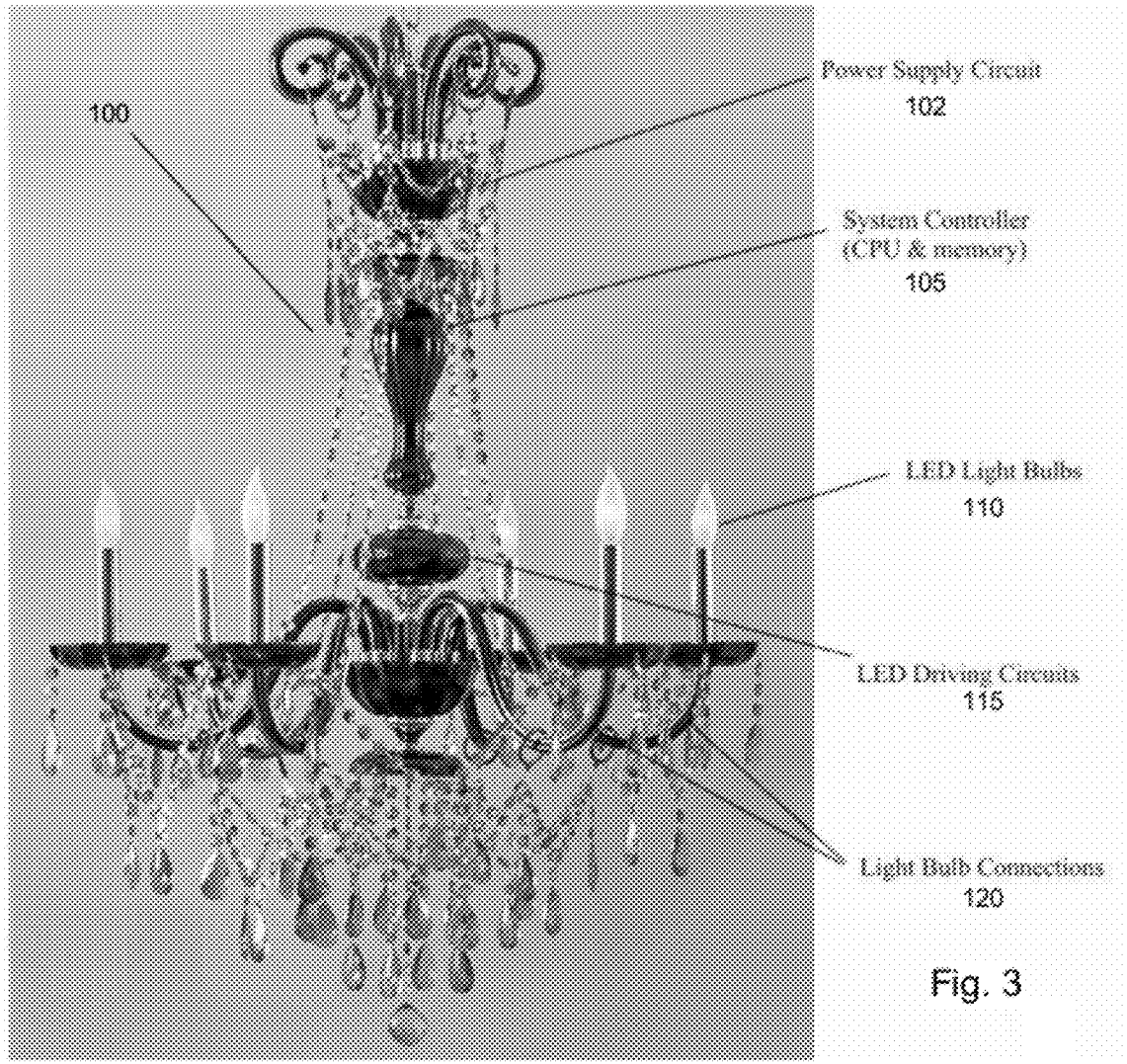
FIG. 3 shows a schematic view of the chandelier of the present disclosure having a light emitting diode bulb, a power supply circuit, a controller, a driving circuit and a connection.

The system structure of the invented new chandelier lamp is illustrated in FIG. 3 and is shown as reference numeral 100. Preferably, the system 100 includes a power supply circuit 102, a controller 105, a number of light emitting diode bulbs 110, a light emitting diode driving circuit 115 and a number of light bulb connectors 120. Preferably, the power supply circuit 102 is operatively connected to a conventional power supply found in a home or business or the like. Preferably, the controller 105 is a digital signal processor and may include a multiple core processor operatively connected to a memory and a bus. The controller 105 preferably provides one or more control signals to a number of light emitting diodes 110 and driving circuit 115 via connections 120. As it shows, the resemblance of the instant chandelier 100 is the same as a traditional chandelier. Various parts of the system structure are embedded inside the driving circuit and are hidden from view so the system 100 appears to be the same as a traditional chandelier system 100 to provide the appropriate aesthetic.

In this illustration, at the top side of the lamp, a power supply circuit 110 is placed inside the half dome shaped member of a housing S or the like. Below that is the system controller 105 including a controller and a memory (not shown). Preferably, the controller 105 is a digital signal processor and the memory includes at least 500 MB. Further, disposed in the system 100, the system 100 includes at least one light emitting diode driving circuit 115 that are operatively connected to at least three light emitting diodes 110. The LEDs 110 in the light bulbs are driven through the connecting wires 120 as in a traditional chandelier lamp. However, since there is a number of different colored LEDs 110 in each light bulb, the bulb 110 requires more wires instead of the 2 wires used in the traditional chandelier. For example, if the light bulb 110 has R, G, B LEDs, then the minimum number of connecting wires 120 from the driving circuit 115 to each light bulb 110 is four wires. That is, one for each color diode and the remaining connecting wire 120 for the LED common connection.

The power supply circuit 102 provides the DC power to run the processor/controller 105. In addition, most of LED drivers 115 operate on DC power as well. Since LEDs 110 are very efficient light sources, this power supply can be quite small in size. For example, a typical chandelier with eight 40 watts light bulbs can emit about 4000 Lumens, which is adequate to illustrate, for example, a dinning room in a home quite brightly. The total power consumption of this traditional chandelier is about 320 Watts. With the eight or more LED light bulbs 110 in the instant chandelier 100, the total power consumption is about 50 Watts. As a result, the power supply size can be quite small and fit inside the chandelier lamp. Various different configurations are possible and within the scope of the present disclosure.

In an alternative embodiment of the present disclosure, the present system 100 may include the power supply circuit 102, the system controller 105, the memory (not shown), and the LED driving circuit 115 all integrated in the LED light bulb 110. This way, the LED light bulb 110 can replace the regular tungsten light bulbs in a traditional chandelier. In another alternative embodiment of the present disclosure, the present system 100 may have the power supply 102 and the controller 105 installed at a top side of a traditional chandelier housing S. The remaining components, for example, the LED chandelier light bulb 110 and the interface and the LED driving circuits 115 may be disposed in a different location. Various alternative implementations are possible and within the scope of the present disclosure.

Figure 4B:
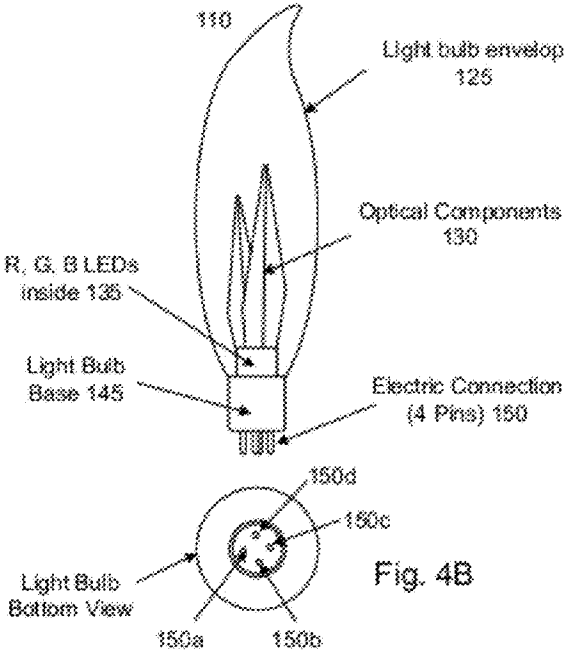
FIGS. 4A, 4B and 5 shows a schematic of the present light emitting diode bulb having three light emitting diodes, an envelope and a base with an optical component and a bottom view of a light bulb illustrating the electric connection.
Figure 4A:
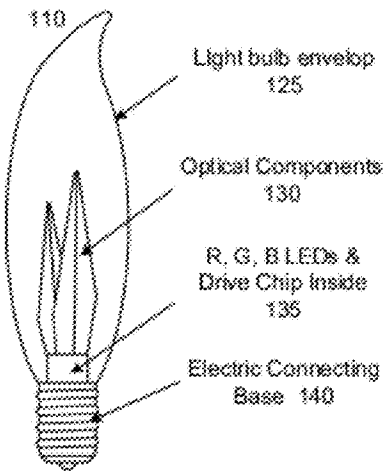
Figure 5:
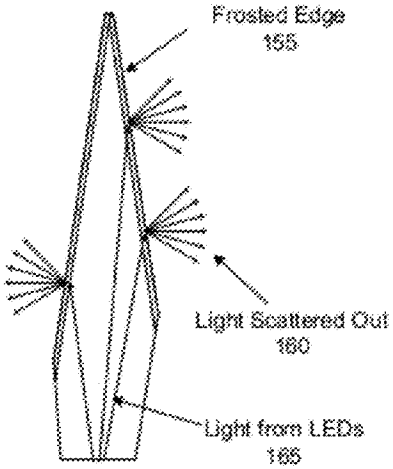

Turning now to FIGS. 4A, 4B and 5, there is shown a schematic view of a number of light emitting diodes 135 captured in a bulb 110 according to the present disclosure generally shown as reference numeral 110. The bulb 110 preferably includes an envelope casing 125. The casing 125 preferably a resilient structure that encircles one or more elements contained inside an interior space. Preferably, the bulb 110 includes one or more optical components 130 and a number of light emitting diodes 135 having an integral drive integrated therein. The number of light emitting diodes 135 are preferably three diodes or a first red light emitting diode, a second green and a third blue light emitting diode, which are operatively connected to an electric connecting base 140.

First, the light bulbs 110 include multi-color light emitting diodes 135. The typical case is to use red (R), green (G), and blue (B) colored light emitting diodes 135 as shown in FIGS. 4A, 4B and 5. R, G, B colored LEDs are available either in separate packages or in one package where the three R, G, and B LED chips are all bonded inside. Multiple LED packages can connected in series to provide more light output, for example, the light emitting diodes 135 can include two or more red, two or more green and two or more blue inside the casing 125. For example, the bulb 110 may include three red, three green, three blue LEDs 135, etc. Bulb 110 includes three driving circuit channels to drive the R, G, and B LEDs in the light bulb separately. The system controller 105 in the chandelier lamp 100 of FIG. 3 can control each driving circuit 115 channel to adjust the brightness (or the emitted light) of the R, G, B light emitting diodes 135 independently. Therefore, the light emitted from the light bulb, which is a mix of the lights from the R, G, B light emitting diodes 135, can have many different colors. If each driving circuit 115 for a given colored light emitting diode 135 can adjust the amount of emitted light from the light emitting diode 135 in eight bits (or 256) levels, then the emitted light from the light emitting diodes 135, which is a mix of the R, G, B colored lights, can form 256×256×256=16.7 million different colors and various different configurations there between. This is very unexpected over the prior art as the present disclosure can provide the same effect visually as a traditional chandelier while being more efficient and providing additional functionality.

The overall construction of the LED light bulb 110 is illustrated in FIG. 4A and FIG. 4B and shows two different embodiments of the base 140 and 150. The LED light bulb 110 has a transparent envelope 125 either made of glass or plastic with the electric connecting base 140 or 150 being disposed below. Preferably, the light emitting diode 135 preserves the overall aesthetic of a traditional tungsten filament chandelier light bulb to the extent that from afar one would confuse the two to preserve the aesthetic.

FIG. 4A shows a light bulb 110 that fits in the sockets on a traditional chandelier lamp and that mates with the base 140. Since the electric connecting base 140 only provides AC power, there should be an IC chip (shown as integrated with reference numeral 135) in each light bulb 110 that can accept the AC input and drive the R, G, B light emitting diodes 135 with brightness adjustments to create various colors. After the tungsten filament light bulbs are replaced with bulb 110, the traditional chandelier can create the lighting effects described in the present disclosure.

FIG. 4B shows a light bulb 110 that is designed for a new type of chandelier lamps. The light bulb 110 only has the R, G, B light emitting diodes 135 therein. All the LED driving and the lighting effect control circuits are located in the chandelier lamp 100. For each light bulb socket 150, the lamp 100 provides four connecting wires, one wire for each of the R, G, B color and the 4th wire for the LED common connection. Each light bulb 110 has 4 electric connecting pins 150*a*, 150*b*, 150*c* and 150*d* as shown in FIG. 4B. The light bulb pins 150*a*, 150*b*, 150*c* and 150*d* interface into the mating sockets of the chandelier (not shown). As a result, light bulb 110 is not compatible to the lamp sockets in a traditional chandelier; however one of ordinary skill in the art would not notice this detail from afar to preserve the overall aesthetic. The new chandelier lamps 110 using the light emitting diodes 135 illustrated in FIG. 4B have the advantage of being lower cost. They are highly suitable for lighting installations in new buildings. On the other hand, the light emitting diodes 135 illustrated in FIG. 4A can replace the extremely in-efficient tungsten filament light bulbs in existing chandelier lamps 100 for energy saving as well as be able to create special lighting effects that do not exist with traditional chandelier lamps.

For both types of light bulbs illustrated in FIG. 4A and FIG. 4B, the R, G, B light emitting diodes 135 are at the bottom part of the light bulb 110 and extend from the base 140 and 150. Above the R, G, B light emitting diodes 135, there are at least one optical component 130 with certain well designed shapes. The light emitted from the R, G, and B light emitting diodes 135 enters optical components 130 from at least one side thereof, preferably from the bottom. As the light travels upward, these optical components 130 may provide or one more optical changes to the light, for example, the components 130 may bend, scatter, and reflect the light such that the components 130 may make the light exit from a specific direction only instead of having all the light going up to the ceiling. The components 130 may also provide that the light exits along a path that comes out at specifically designed places to mimic a light emitting tungsten filament in a traditional chandelier light bulb. This creates the sparkling feeling that makes chandelier lamps so desirable.

The optical components 130 may include a lens, diffuser, and/or reflector or any other transparent objects containing at least one of a sharp edge, a prism shape, a diffuser, a light diffusing surface, etc. FIG. 5 show the bulb 110 having an optical component 130 providing at least two beams 160 and 165. The beam 165 is from the light emitting diode 135 while the second beam 160 is scattered in a predetermined direction to provide a specific predetermined lighting effect. Optical component 130 preferably has a shape or includes edges with frosted finishing 155 shown in FIG. 5. As the light from the light emitting diodes 135 travels upward and reaches the sharp frosted edges 155, the light is scattered out, which makes the frosted sharp edges 155 brightly lit. This mimics the light emitting tungsten filaments as shown in FIG. 5.

In order to enhance the brightness of the sharp frosted edges 155, the flat regions of the optical object 130 may have partial reflective coatings. As the light reaching the flat regions of the optical object 130, a portion of the light is reflected back and then hit the frosted edges 155 and is scattered out. This enhances the brightness of the frosted sharp edges 155 to mimic a light emitting filament more closely and provide a sharp aesthetic whereas an individual would enjoy the benefits of light emitting diodes 135 while preserving the conservative look and feel of a traditional chandelier. Various optical components are possible and within the scope of the present disclosure and other optical component to create bright lines and spots to mimic the appearances of a light emitting tungsten filament in a traditional chandelier light bulb may be used.

Figure 6:
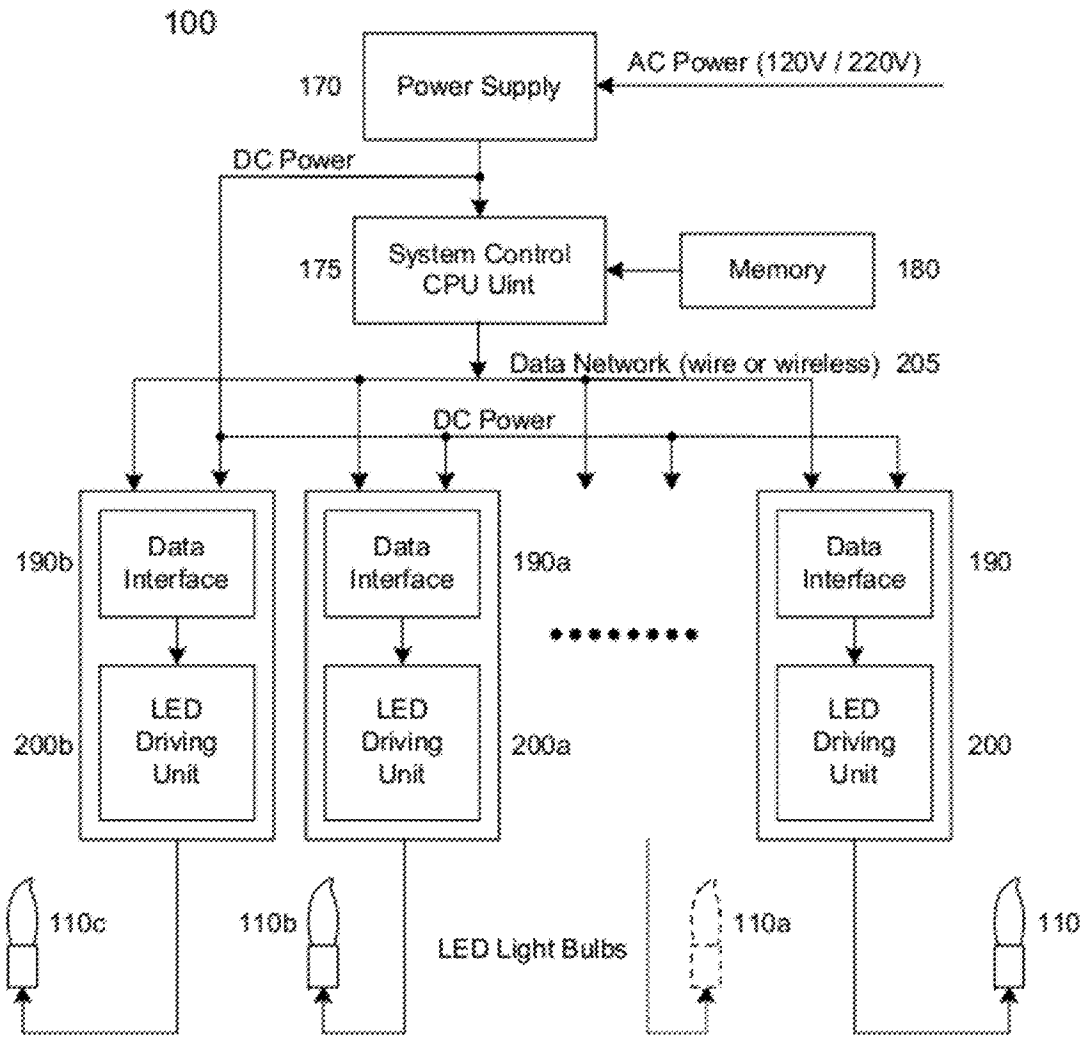
FIG. 6 shows a schematic of the present chandelier with a power supply, a controller, a memory, a data interface, a driving circuit and a light emitting diode bulb.

Turning now to FIG. 6, there is shown the chandelier lamp 100 having the lighting controller architecture. The lamp 100 includes a number of light emitting diode bulbs 110, 110*a*, 110*b*, 110*c* etc. The bulbs 110, 110*a*, 110*b*, 110*c* are each connected to a light emitting diode driving unit 200, 200*a*, 200*b*, which are connected to a data interface 190, 190*a*, and 190*b*. The data interface 190, 190*a*, 190*b* and the light emitting diode driving unit 200, 200*a*, 200*b* are controlled by, and receive signal from a controller, (CPU) 175 and memory 180. A power supply 170 is connected to provide power from an AC power supply (120V/220V) and converts the signal to a DC power to the data interface 190, 190*a*, and 190*b* and to the light emitting diode driving unit 200, 200*a*, 200*b* to the light emitting diode bulbs 110, 110*a*, 110*b* and 110*c*.

Figure 7:
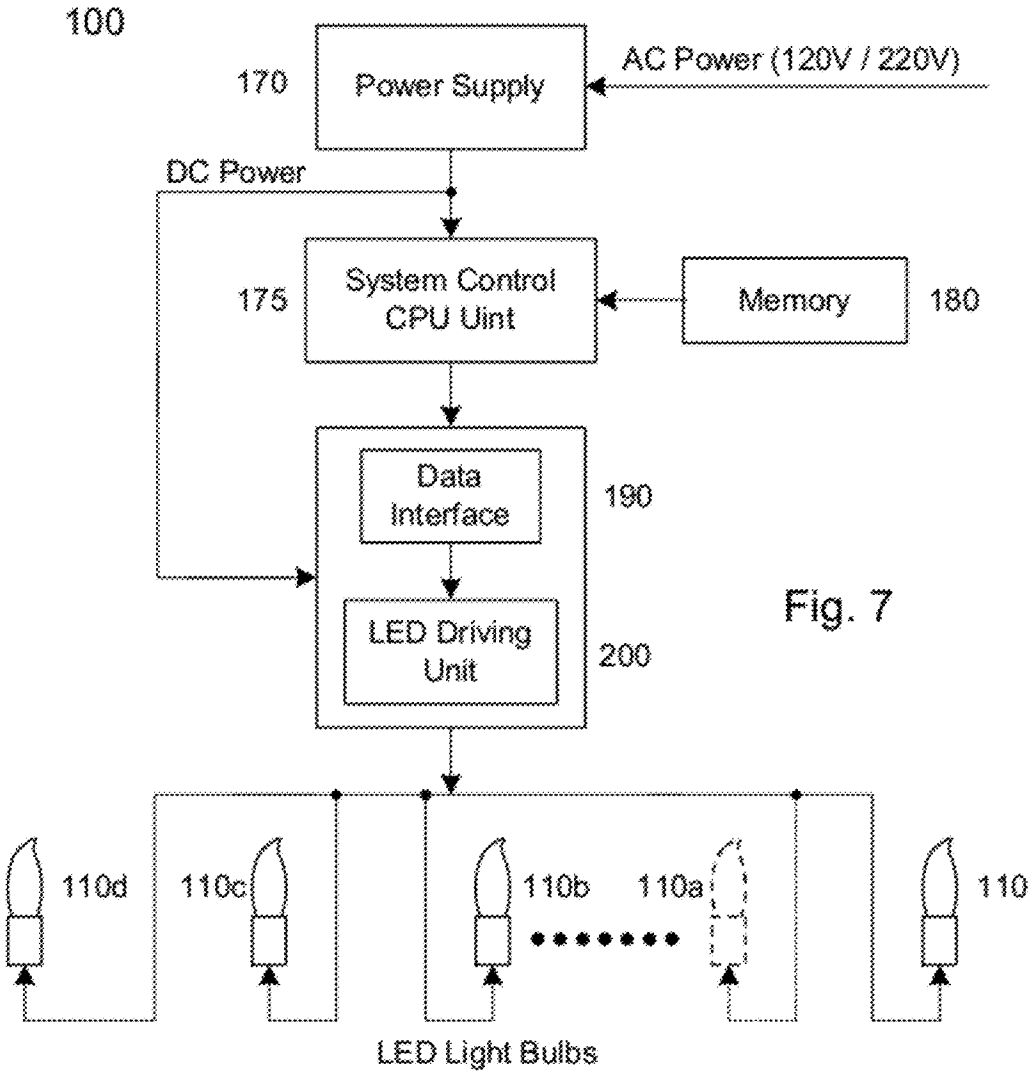
FIG. 7 shows a schematic of an alternative embodiment of the chandelier with a power supply, a controller, a memory, a single data interface, a single driving circuit and a number of light emitting diode bulbs.

Turning now to FIG. 7, there is shown an alternative controller 175 configuration. In the system 100, there is only one data interface 190 and one light emitting diode driver unit 200. All the bulbs 110, 110*a*, 110*b*, 110*c*, and 110*d* of the chandelier lamp system 100 are being driven in parallel. Again, the light emitting diode driver unit 200 has 3 driving channels, one for each R, G, B color LEDs 110-110*d*. The LEDs 110-110*d* of a given color, for example red, in the light bulbs 110-110*d* are connected in parallel and are driven by one channel in the light emitting diode driver unit 200. As a result, the color and time sequence of the light emitted from every light bulb 110-110*d* are the same.

The system 100 of FIG. 7 does not have light emitting diode driver unit 200 in each light bulb as compared to FIG. 6; this system 100 requires the LED chandelier light bulbs 110*a*, 110 as illustrated in FIG. 4B. That is, each light bulb has four connecting pins 150*a*-150*d* and also the chandelier preferably has sockets (not shown) with four connecting wires to each light bulb 110, 110*a* etc.

It should be appreciated that the simplified light controller 175 is suitable for moderately priced chandelier lamps and small size chandeliers with a few (such as 6-12) light bulbs 110, 110*a*, 110*b*, 110*c*, and 110*d*. At any instant, the color of the light emitted by the light bulbs 110-110*d* of the lamp 100 may be the same. On the other hand, with the light controller illustrated in FIG. 6, the light bulbs of the lamp can have different lighting colors and sequences. The following is an example where this option can enhance the lighting show.

Large size chandeliers may have the light bulbs 110-110*d* arranged in several circles at different heights. When the overall room illumination is set at white, with the light controller 175 illustrated in FIG. 6, it is possible that the light bulbs 110-110*d* at different heights can have different colors. In addition, the colors of the light bulbs 110, 110*a*, 110*b*, 110*c* can change slowly but the overall illumination of the room, which is a mixture of the lighting colors of all the light bulbs 110, 110*a*, 110*b*, 110*c* can remain in white. However, the reflections from the optical components 130 around the light bulbs can be in different colors. This enhances the overall sparkling effect of the chandelier lamp.

Turning again to FIG. 6, the central processor 175 can be implemented with various commercial CPUs that are available on the market, such as an 8-bit 8051 CPU or a 32-bit ARM microprocessor and may others. The choice of CPU 175 relies on the complication of the entire system 100 and the program instructions required providing the one or more decorative lighting effects therein. The central processor 175 preferably controls the light emitting diode driving circuits 200, 200*a*, 200*b* etc. to operate the R, G, B light emitting diodes 135 in the light bulbs 110, 110*a*, 110*b*, 110*c* at various brightness levels according to either the present sequences stored in the memory 180 or the instructions from the accessory devices. The central processor 175 preferably interacts with the accessory devices through either wired or wireless connection generally shown as reference numeral 205 for various functions. The central processor 175 preferably can be implemented with a new LED set (not shown) (including both LED Driving Circuit and LED bulb). Preferably, the wireless connection may interrogate an external LED set and the new external LED set can dynamically participate within the chandelier lamp network system and the central processor 175 will recognize the external LED. Processor 175 may control the wireless network to establish a communication path and set automatically and assign it a unit ID number for future data communication identification. The interface to the Data Interface Unit, the "Data Network" 190 connection shown in FIG. 6, can be either wire or wireless connection. For wireless implementation, some technologies currently available on the market, such as ZigBee®, Infrared, Bluetooth, IEEE 802.11, can be used. If a wireless data interface is implemented, a wireless control module should also be included in the System Control CPU Unit 175. ZigBee® is a specification for a suite of high level communication protocols using small, low-power digital radios based on the IEEE 802.15.4-2003 standard for wireless personal area networks (WPANs), such as wireless headphones connecting with cell phones via short-range radio. The technology defined by the ZigBee® specification, which is incorporated by reference in its entirety and is intended to be simpler and less expensive than other WPANs, such as Bluetooth. ZigBee® is targeted at radio-frequency (RF) applications that require a low data rate, long battery life, and secure networking.

The data interface network unit 190 is designed for data communication between the system control CPU unit 175 and each of the LED driving unit 200, 200*a*, 200*b* as shown in FIG. 6. It can be implemented as either a wired or a wireless network. For wireless implementation, typically a short distance (less than 10 meters) wireless data communication infrastructure is chosen. There are various modern wireless technologies on the market, such as Infrared (IR), ZigBee, Bluetooth, wireless 1394, and IEEE802.11 (WIFI), etc. The choice of wireless technology relies on the complication and the pricing of the new chandelier lamp system. Data Interface Unit 190 preferably receives the instruction command and data sent from the System Control CPU 175, then decodes and executes the instruction to control the lighting of the LED light bulbs 110, 110*a*, 110*b* and 110*c*. Data Interface Unit 190 preferably embedded register files which store configuration of each light emitting diode 135 located in the bulb 110 (R, G, and B) driving pulse width modulation (PWM) signal. The configuration set up is based on the instruction from the processor 175.

Data interface unit 190 preferably generates three different PWM signals, one for the Red LEDs 135, one for the Green LEDs 135, and one for the Blue LEDs 135 in the light bulbs 110, 110*a*, and 110*c*. Data Interface Unit 190 preferably transmits a signal to the LED Driving Unit 200, 200*a*, and 200*b* to control the brightness of the emitted light for each red, green and blue color.

If the interface is implemented in wireless manner, the system 100 further includes a secondary wireless module to achieve wireless protocol communication with the CPU unit 175 in a primary secondary relationship. The LED driving unit 200, 200*a*, 200*b* has three channels of the driving circuit, one for each red, green and blue light emitting diode 135. Each channel driving circuit 200, 200*a*, 200*b* takes in the PWM control signal from the Data Interface Unit 190, 190*a*, and 190*b* and modulates the LED current going through the light emitting diodes 135 of each color in the light bulb. Various current parameters are possible and within the scope of the present disclosure.

There are various LED driving integrated circuit devices 200, 200*a*, and 200*b* that can be used with the present system. The choice relies on the specific requirements of the system 100, such as maximum driving current (the maximum emitted power of each LED bulb 110-110*c*), how many LED light bulbs 110-110*c* in the chandelier 100, and the various lighting effects desired.

The light emitting diode driving unit 200, 200*a*, and 200*b* preferably receives the pulse width modulation signals (PWM) from the data interface unit 190, 190*a*, and 190*b* and modulates the current of each R, G, and B light emitting diode 135 to control a brightness or intensity independently. The light emitting diode driving unit 200, 200*a*, and 200*b* preferably is configured for different maximum output current. This feature is required to tune the circuit to fit for various power emitted LED systems. For instance, some available LED driving IC devices use external resistors to configure the maximum output current to drive the LEDs 135. The light emitting diode driving unit 200, 200*a*, and 200*b* preferably has an over voltage protection function to avoid damaging the chandelier lamp from a single LED light bulb 110, 110*a*, 110*b* failure.

The system 100 also includes a power supply unit 170 that converts the AC 120/240 Volt (from the house outlets) power to a DC power which is suitable for running the controller 175, the data interface unit 190, 190*a*, 190*b*, and the light emitting diode driving unit 200, 200*a*, and 200*b* of the chandelier lamp system 100. For large chandelier lamps 100 that may have hundreds of LED light bulbs 110, 110*a*, 110*b*, and the power supply unit 170 may have at least two DC voltage output ports. A low power output for the system control unit 175 and the data interface unit 190, and a high power output port to run the LED Driving units 200-200*b*. This two port embodiment reduces the DC current that the LED driving unit 200, 200*a*, and 200*b* receives.

There are basically two or more ways to implement the system 100. The first way is a new type of chandelier lamp 100 for new installations. The second is intended to outfit or modify the existing chandelier lamps 100 already installed and intended to be upgraded to the new chandelier system 100 in a retrofit configuration.

Figure 9:
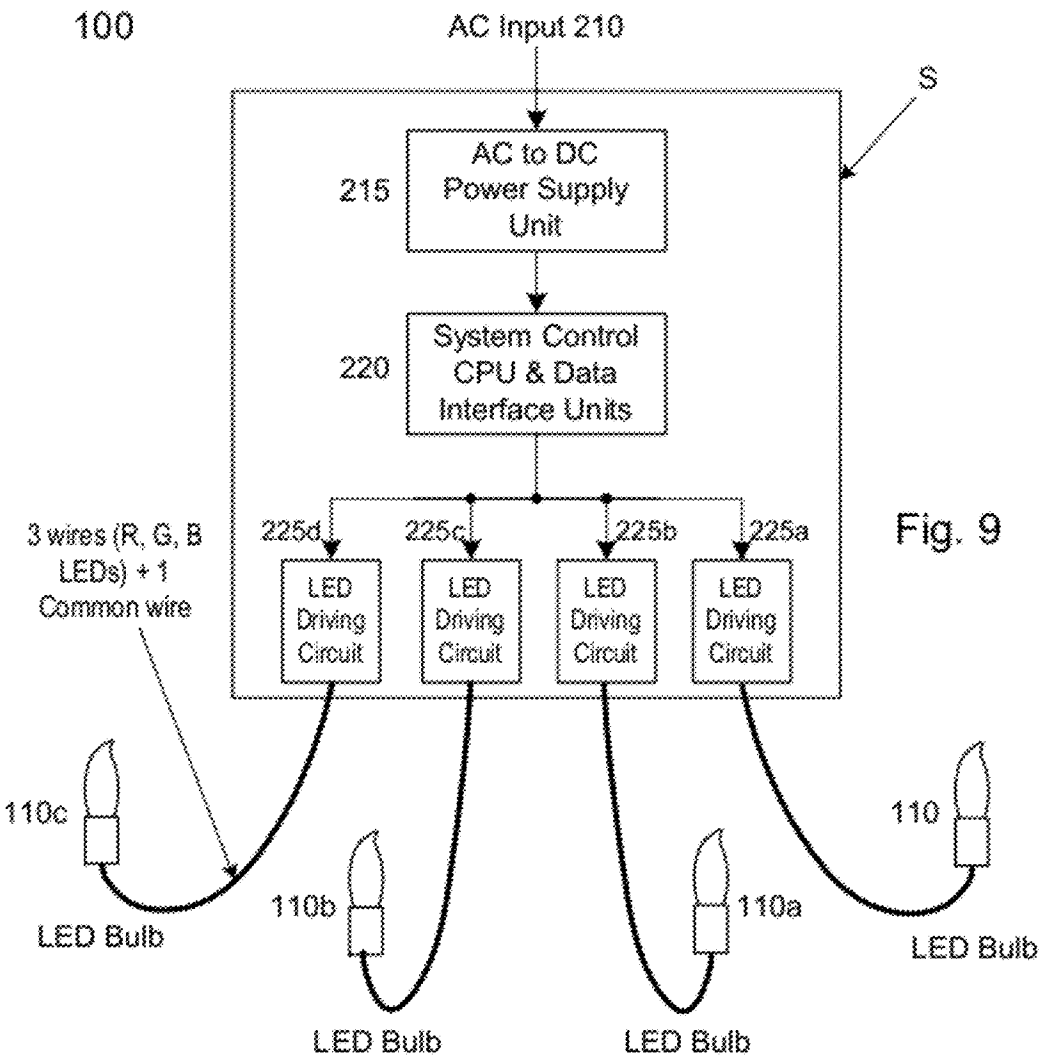
FIG. 9 shows a schematic of an alternative embodiment of the chandelier with a power supply, a converter, an integrated controller and data interface unit, a number of driving circuits and a number of light emitting diode bulbs.

FIGS. 9-12 describe various different embodiments. The first two embodiments are for a new kind of chandelier lamps not compatible to the traditional chandelier lamps. The other two are embodiments that can modify or outfit a traditional chandelier lamp to the chandelier system 100. FIG. 9 shows a new embodiment of the present disclosure generally as reference numeral 100. The system 100 includes an AC input 210 connected to an AC/DC power supply unit 215. Unit 215 is connected to a controller 220 that includes an integrated data interface unit. The controller/data interface unit 220 is connected to a number of light emitting diode driving circuits shown as 225*a*-225*d*. The driving circuits 225*a*-225*d* are connected to a number of light emitting diode bulbs 110-110*c* as shown in FIG. 4B. The system 100 is preferably an embodiment for a new installation and includes separate LED driving circuits 225*a*-225*d*, one for each LED light bulb 110-110*c*, also in the main structure of the chandelier 100. Thus, the LED bulb 110 only has R, G, and B LEDs 135 inside. The connection between the central part of the chandelier 100 and the LED bulbs 110 are four DC power wires, three for R, G, B LED connections and one for common connection.

One advantage is that all the control circuit 220 is centralized in the system 100. The LED light bulb 110-110*c* has a very simple structure, includes only the R, G, B LEDs with no driving circuit 225-225*d* inside. As a result, this is a relatively low cost implementation of the chandelier lamp system 100. In addition, since each LED light bulb 110-110*c* is separately driven and controlled, the lamp 110-110*c* can deliver all the possible lighting effects of this chandelier lamp system 100.

Figure 10:
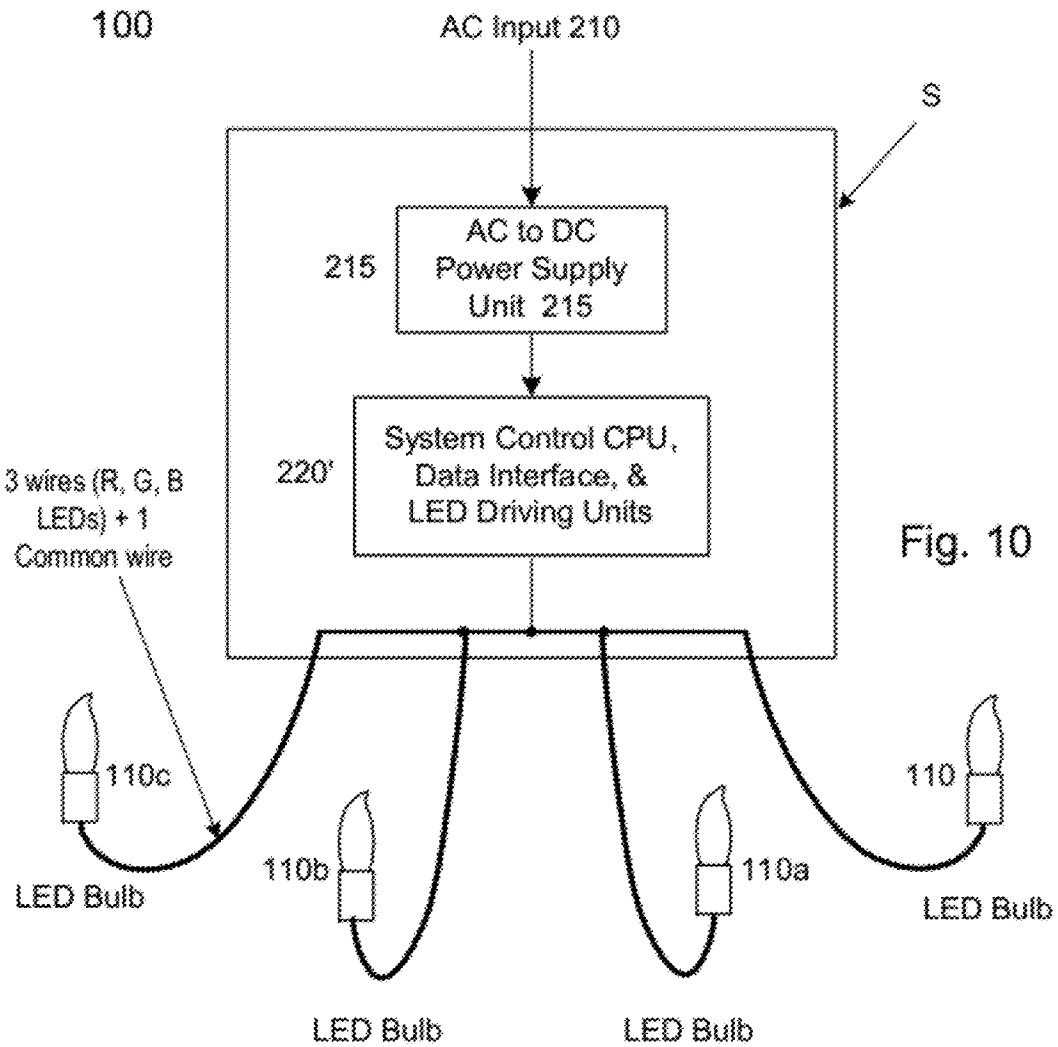
FIG. 10 shows a schematic of an alternative embodiment of the chandelier with a power supply, a converter, an integrated controller, data interface unit and driving circuit and a number of light emitting diode bulbs.

FIG. 10 shows a new embodiment of the present disclosure generally as reference numeral 100. The system 100 includes an AC input 210 connected to an AC/DC power supply unit 215. Unit 215 is connected to a controller 220' that includes an integrated data interface unit and LED driving unit generally shown as 220'. The controller/data interface unit/driver unit 220' is connected to a number of light emitting diode bulbs 110-110*c*. The connection between the central part of the chandelier and the LED bulbs 110 are four DC power wires, three for R, G, B LED 135 connections and one for common connection. Preferably, the implementation of FIG. 10 is also for a new kind of chandelier lamp system 100.

All the LED light bulbs 110-110*c* are connected in parallel and are driven by the same driving circuit 220'. As a result, the light emitted from each LED light bulb is the same. The main advantage of this implementation of FIG. 10 is the low cost. Thus, it is particularly suitable for low price chandelier lamps as well as small size chandeliers lamps with a few light bulbs. The disadvantage of this implementation is that the lighting effects delivered by the chandelier are not as sophisticated as the system 100 of FIG. 9, which have different drivers 225*a*-225*d*.

Figure 11:
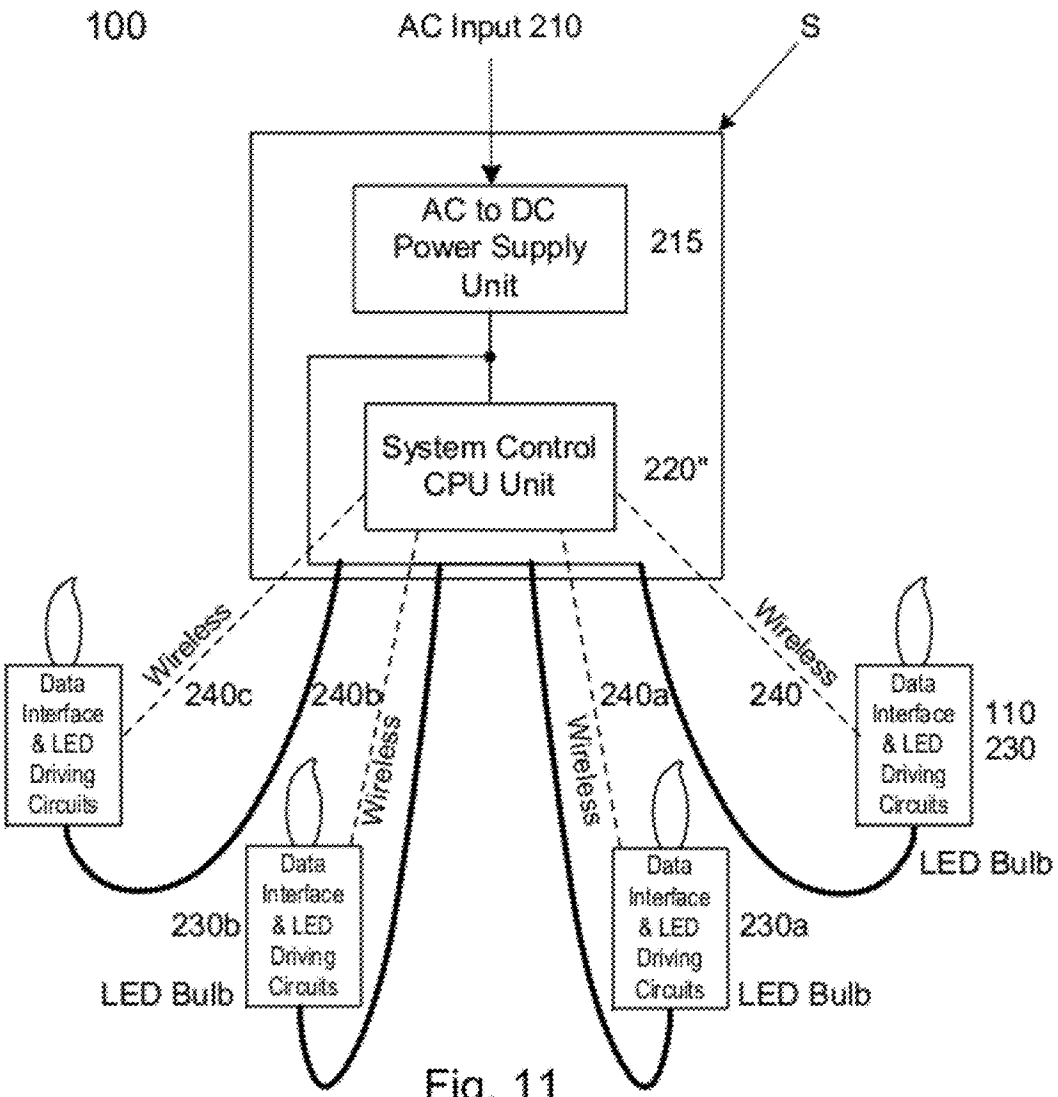
FIG. 11 shows a schematic of an alternative embodiment of the chandelier with a power supply, a controller, and an integrated data interface unit and driving circuit located integrated within each of the number of light emitting diode bulbs.

FIG. 11 shows a new embodiment of the present disclosure generally as reference numeral 100. The system 100 includes an AC input 210 connected to an AC/DC power supply unit 215. Unit 215 is connected to a controller 220". The controller 220" preferably includes a radiofrequency wireless device to communicate with one or more data interface and driving circuits 230-230*c* that are integrated with the bulbs 110 generally shown as reference numeral 230-230*c*. By integrated it is meant the components are located in generally the same location as the bulbs as opposed to inside the housing. The controller 220" preferably wirelessly communicates along one or more wireless paths 240-240*c* with components of the system. Preferably, the embodiment is for mainly modifying the traditional chandelier lamps in a retrofit manner. After modification, the chandelier lamp 100 has the power supply unit 215 and the system control unit 220" in its main structure as shown by reference letter S.

Each LED light bulb 230-230*c* comprises data interface unit and the LED driver circuit as a discrete package. The light bulb has the same connecting head as a tungsten filament chandelier light bulb for ease of installation as is known in the art. During the modification, one has to install the power supply 215 and the control module 220" either in some part of the traditional chandelier lamp S or above the room ceiling where the chandelier 100 is installed. Thereafter, the original tungsten filament light bulbs are removed and discarded and base of light bulb 230-230*c* is inserted to convert the lamp 100 to the embodiment shown. The communication between the system control CPU unit 220" and each LED light bulb 230-230*c* can be wireless (as it is illustrated in FIG. 11 by paths 240-240*c*) or through the original wires to each light bulb 110. Some already installed chandeliers may not be able to be modified in a commercially viable manner.

Figure 12:
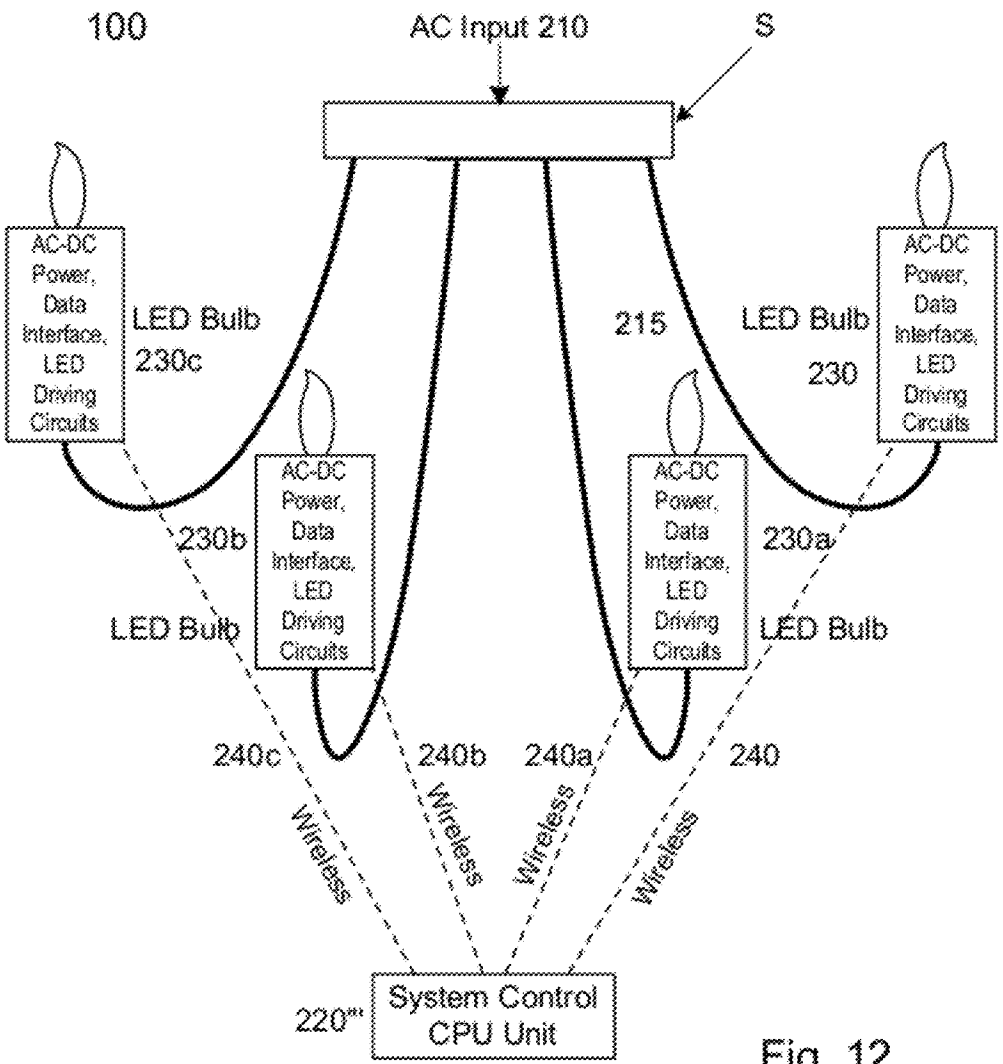
FIG. 12 shows a schematic of yet another alternative embodiment of the chandelier with a power supply and an external controller, and an integrated AC/DC power converter/data interface unit/driving circuit located integrated within each of the number of light emitting diode bulbs.

FIG. 12 shows a new embodiment of the present disclosure generally as reference numeral 100. The system 100 includes an AC input 210 located in the housing S. The system 100 also includes a controller 220'" that is not located in the housing S by in a different location, for example on a console or the like. The controller 220'" preferably includes a radiofrequency wireless device to communicate with one or more of the data interface and driving circuits 230-230*c* that are integrated with the bulbs generally shown as reference numeral 230-230*c*. In this embodiment, the bulbs have AC/DC power converters, driving circuits and a data interface in a small package that fits into a socket of a preexisting lamp socket. The controller 220'" preferably communicates along one or more wireless paths 240-240*c*. Preferably, the embodiment is for mainly modifying the traditional chandelier lamps in a retrofit manner. The embodiment shown in FIG. 12 has the power supply unit besides the data interface and the LED driving circuit in each lamp shown as reference numeral 230-230*c*. Therefore, the light bulb can be run directly from the AC voltage supplied by the traditional chandelier lamp by input 210. The system control CPU unit 220'" is now a separate piece of device that can be installed anywhere in the room. It controls the LED light bulbs 230-230*c* through a wireless communication protocol. The LED light bulbs 230-230*c* for the FIG. 12 implementation would be slightly more expensive than the one used in the embodiment of FIG. 11. However, it might offset the labor cost to modify the traditional chandelier so the total cost may be lower than the one used in the embodiment of FIG. 11.

As a part of the present disclosure, there are several accessory devices that the user can use to control the system 100 including selecting the lighting effects and down loading and storing new lighting effects through various wired and wireless communication protocols. The system 100 of FIG. 12 may include a wireless remote control device (not shown) that can provide a control signal to a receiver operatively connected to the controller 220'''. Normally, the chandelier lamp system 100 is hanging on the ceiling and is difficult to reach for changing processor commands or installing new programming instructions. The wireless remote control device is designed to overcome this issue. It can send commands and instructions to the System Control CPU Unit 220''' on the system 100 remotely or in the CPU of any other embodiment. Instead of using a wireless remote control device, a wired remote control device can be used to interact with the System Control CPU Unit 220''' on the chandelier system 100 or the remaining embodiments. Usually, the wired remote control device can be embedded inside the light switch on the wall.

The system 100 may further comprises an audio sensing device (not shown), which is operatively connected to a wireless device to provide one or more control signals to a processor 220'''. The device may sense the audio sound and interacts with the System Control CPU Unit 220''' to create lighting effects according to the sound levels, frequencies, etc. For example, when music is played around, the audio sensing device senses the music and interacts with the System Control CPU 220''' to create lighting shows responding to the music. For example, a pulsed lighting may accompany the venue such as a dance club or the like. The audio sensing device may be tuned with the light emitting diodes to change the brightness level of the light, to change the color of the light emitting diodes and also to change a flicker rate of the light emitting diodes so the light from the chandelier lamp (brightness and color) changes with the music, and the method can be controlled by other accessory devices. The brightness, flicker and color may be set to change the lighting effects for rock & roll music, and the brightness and color may be set to change at a different rate for a waltz, etc.

This is a very attractive feature in situations of dancing parties, music concerts, and song singing. The audio sensor device can be installed inside the chandelier lamp housing S or as an accessory installed elsewhere. When needed, the audio controlled light effect mode can be activated through the wired or wireless remote control devices. In the meantime, various different lighting shows responding to the surrounding sound can be selected. Customized software can be developed for personnel cell phone and PDAs, for example, an APPLE® I-PHONE® or the like.

With it, the remote control of the system 100 can be achieved through personnel cell phone and PDAs. The system 100 may further include a network connection device and the system 100 can be integrated with the network connection devices, such as Ethernet device, to participate as a node in the home networking system. In this way, the system 100 can receive one or more control signals from a network and be controlled through any computer at home or even be remote accessed and controlled through the office computer that is miles away from home. The system 100 may further comprise a brightness sensor device (not shown). A brightness sensor device can be integrated with the system control CPU unit 220'''. It will detect the brightness of the environment and automatically issue an instruction command to the CPU 220''' to control the dimming of the LED light bulb 230-230*c*. Again, the activation of brightness sensor device can be done through wired or wireless remote control unit. For example, during the daytime the sensor may control the system 100 to turn the lamps 110 off while at night the sensor may control the system 100 to turn the lamps 110 on.

Figure 13:
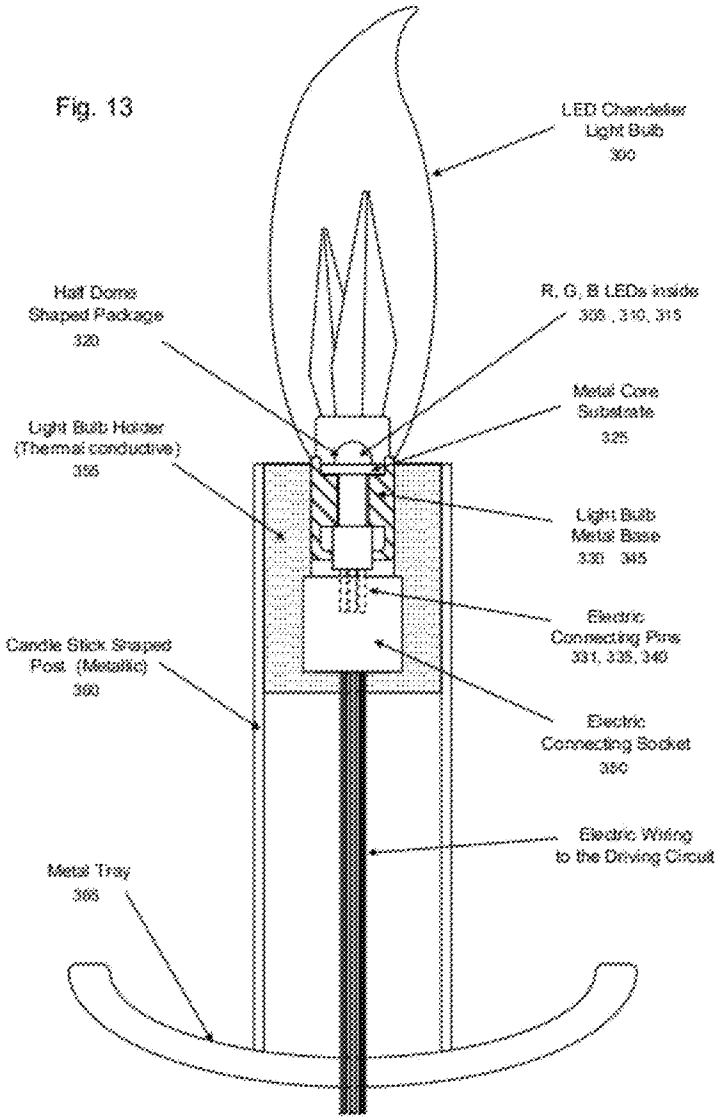
FIG. 13 shows a chandelier with a device for dissipating heat.

Turning now to FIG. 13, there is shown an alternative bulb according to the present disclosure generally shown as reference numeral 300. One of the major issues using light emitting diodes for lighting is to keep the light emitting diodes 305-310 cool. For general lighting, the light emitting diode light bulb typically has to generate about 500 to about 1000 lumens of light or more. At an efficiency of 60 Lumens per Watt, the power consumption of the light emitting diode light bulb 300 is 8.3 to 16.7 Watts. Since the performance of light emitting diodes 305-310 decay rapidly as a substrate temperature rises beyond 70 degrees C., it is favorable to dissipate the heat and maintain the light emitting diodes 305-310 cool to prevent a failure.

The problem is more serious for chandelier light bulb. FIG. 13 shows a heat dissipation embodiment for a high power LED chandelier light bulb that can look like a traditional chandelier light bulb. With this embodiment, an LED chandelier light bulb has the same light output and same shape as a 60 watts tungsten filament chandelier light bulb can be made.

A chandelier lamp has cylindrical shaped posts under the light bulbs that mimic the outlook of candle sticks. These posts are made from metal or plastic. This embodiment uses these posts to dissipate the heat generated by the high power LEDs inside the light bulbs.

To make it effective, the posts 230 are made from metal. Thermally, each post is in direct contact with the metal base of the LED chandelier light bulb above it. As a result, the heat generated by the LEDs inside the light bulb can be effectively conducted to the post below. Since the surface area of the post is quite large, it can dissipate a large amount of heat and keep the LEDs inside the chandelier light bulb cool.

In general, the LED light bulbs in this invented new chandelier lamp are run on DC current with low voltage (for example, 10-20 V). These voltage levels are save and do not require insulation. So, the metallic post can be in direct contact electrically with the LED light bulb above. In fact, the metallic post can be the common electric contact of the red, green and blue light emitting diodes inside the light bulb.

FIG. 13 shows a light bulb 300 contains R, G, B LEDs 305, 310, 315 in a half dome shaped package 320. This R, G, B LED package is mounted on a metal core substrate 325 which is attached to the metal base 330 of the chandelier light bulb. Thus, the heat generated by the LEDs 305, 310 and 315 can be conducted to the metal core substrate 325 and then to the metal base 330 of the light bulb.

The LED chandelier light bulb 300 shown in this figure has three pins 331, 335, 340 for the electric connections to the R, G, B LEDs 305-315. The common connection of the LEDs is through a candelabra metal base 345. The LED chandelier light bulb plug into a 3-pin socket 350 embedded in a light bulb holder 355. The outside surface 360 of this light bulb holder 355 is in contact with the candle stick shaped post 360. As in most of the chandelier lamps, the bottom side of the post 360 is attached to a metal tray 365. So, the combination of the light bulb 300, the post 360, and the tray 365 simulates the shape of a candle stick in a tray very well.

The light bulb holder 355 can be made from metal or other thermal conductive materials. The heat from the LEDs 305-310 can be dissipated effective to the metal core substrate, then to the light bulb metal base 330, then to the light bulb holder 355, and finally to the post 360 and the metal tray 365. Since the surface areas of the metal post 360 and the tray 365 are quite large, the LEDs 305-315 inside the chandelier light bulb 300 can be maintained at a temperature cool enough for good lighting efficiency and long life.

If the LED chandelier light bulb 300 has to produce the same amount of light as a 60 watts traditional chandelier lamp (about 750 lumens), the LEDs 305-315 inside the light bulb 300 have a total power about 12.5 watts. So, the average power dissipated to the air from the post 360 and the metal tray 365 is about 0.6 watts per square inch.

Generally, in operation, the computer system operable with that method shown in FIGS. 6-12 is controlled by an operating system. Typical examples of operating systems are MS-DOS, Windows95, 98, 2000, XP, Vista and Windows 7 from Microsoft Corporation, or Solaris and SunOS from Sun Microsystems, Inc., UNIX based operating systems, LINUX based operating systems, or the Apple OSX from Apple Corporation. As the computer system operates, input such as input search data, database record data, programs and commands, received from users or other processing systems, are stored on storage device. Certain commands cause the processor to retrieve and execute the stored programs. The programs executing on the processor may obtain more data from the same or a different input device, such as a network connection. The programs may also access data in a database for example, and commands and other input data may cause the processor to index, search and perform other operations on the database in relation to other input data. Data may be generated which is sent to the output device for display to the user or for transmission to another computer system or device. Typical examples of the computer system are personal computers and workstations, hand-held computers, dedicated computers designed for a specific purpose, and large main frame computers suited for use many users. The present invention is not limited to being implemented on any specific type of computer system or data processing device.

It is noted that the present invention may also be implemented in hardware or circuitry which embodies the logic and processing disclosed herein, or alternatively, the present invention may be implemented in software in the form of a computer program stored on a computer readable medium such as a storage device. In the later case, the present invention in the form of computer program logic and executable instructions is read and executed by the processor and instructs the computer system to perform the functionality disclosed as the invention herein. If the present invention is embodied as a computer program, the computer program logic is not limited to being implemented in any specific programming language. For example, commonly used programming languages such as C, C++, JAVA as well as others may be used to implement the logic and functionality of the present invention. Furthermore, the subject matter of the present invention is not limited to currently existing computer processing devices or programming languages, but rather, is meant to be able to be implemented in many different types of environments in both hardware and software.

Furthermore, combinations of embodiments of the invention may be divided into specific functions and implemented on different individual computer processing devices and systems which may be interconnected to communicate and interact with each other. Dividing up the functionality of the invention between several different computers is meant to be covered within the scope of the invention.

While this invention has been particularly shown and described with references to a preferred embodiment thereof, it will be understood by those skilled in the art that is made therein without departing from the spirit and scope of the invention as defined by the following claims.

What is claimed is:

1. A method for providing a decorative lighting effect comprising:

providing a chandelier lamp comprising at least one chandelier bulb, wherein each of said chandelier bulb comprise at least one set of three light emitting diodes disposed inside said chandelier bulb, and wherein each of said set of three light emitting diodes comprises a red LED (light emitting diode), a green LED, and a blue LED:

providing a power supply for AC/DC conversion;

providing optical components comprising one or more of a lens, a diffuser, and a reflector, wherein said optical components are disposed above said light emitting diodes;

providing a controller comprising a digital signal processor and a multiple core processor operatively connected to a memory, wherein said controller is wirelessly connected to one or more data interface units, wherein said one or more data interface units are connected to said one or more said LED driving circuits, and wherein said one or more LED driving circuits are connected to said light emitting diodes for driving said light emitting diodes;

controlling said light emitting diodes wirelessly using said controller, said one or more data interface units and said one or more LED driving circuits;

reflecting, diffusing, and bending light emitted by the light emitting diodes using said optical components, to create a sparkling appearance that mimics effects similar to a traditional chandelier light bulb having tungsten filaments; whereby the light emitting diodes are controlled to provide said decorative lighting effect.

2. The method of claim 1, further comprising controlling the brightness of the light emitting diodes.

3. The method of claim 1, further comprising controlling the intensity of the light emitting diodes.

4. The method of claim 1, further comprising controlling the brightness and intensity of the light emitting diodes to provide a flickering effect that resembles a candle light or to change a color of the illuminated light.

5. The method of claim 1, further comprising transmitting the light through at least one optical component.

6. The method of claim 5, further comprising scattering the light and diffusing the light via the optical component to provide a decorative effect.

7. The method of claim 1, further comprising providing the light emitting diodes in an electric connecting base that is inserted into a socket of an existing chandelier in a retrofit manner.

8. The method of claim 1, further comprising providing the light emitting diodes in an electric connecting base that comprises at least four pins that mate with at least four sockets in a chandelier.

9. The method of claim 1, further comprising further providing the light emitting diodes in an envelope having an integrated optical component therein.

10. The method of claim 1, further comprising controlling the lighting emitting diodes to flicker, to emit white light, to emit colored light, or to give the appearance of a tungsten filament, or to give the appearance of a candlelight.

11. A chandelier bulb for providing a decorative lighting effect comprising:

at least one set of three light emitting diodes, wherein each of said set of three light emitting diodes comprises a red LED (light emitting diode), a green LED, and a blue LED;

an envelope casing for the light emitting diodes;

a driving circuit connected to the light emitting diodes for driving the light emitting diodes; and optical components comprising one or more of a lens, a diffuser, and a reflector, wherein said optical components are disposed above said light emitting diodes, and wherein said optical components reflect, diffuse, and bend light emitted by said light emitting diodes to create a sparkling appearance that mimics effects similar to a traditional chandelier light bulb having tungsten filaments.

12. The chandelier bulb of claim 11, further comprising an electric connecting base being connected to the envelope, wherein the electric connecting base is connected to a socket in a chandelier.

13. The chandelier bulb of claim 12, wherein the electric connecting base has at least four pins, wherein the at least four pins are connected to at least four sockets in the chandelier.

14. The chandelier bulb of claim 11, wherein the optical component alters a path of the light emitted from the bulb.

15. The chandelier bulb of claim 11, wherein the driving circuit receives a signal from a controller and a memory such that the controller provides control instructions to the light emitting diodes; and the controller controls the at least three light emitting diodes to provide a decorative lighting effect.

16. A chandelier lamp for providing a decorative lighting effect comprising:

a power supply for AC/DC conversion;

said chandelier lamp comprising at least one chandelier bulb, wherein said chandelier bulb comprises at least one set of three light emitting diodes disposed in the chandelier bulb, and wherein each of said set of three light emitting diodes comprises a red LED (light emitting diode), a green LED, and a blue LED;

an envelope casing for the light emitting diodes;

a controller comprising a digital signal processor and a multiple core processor operatively connected to a memory, wherein said controller is wirelessly connected to one or more data interface units, and wherein said one or more data interface units are connected to said one or more said LED driving circuits, and wherein said one or more LED driving circuits are connected to said light emitting diodes for driving said light emitting diodes;

said controller wirelessly controlling said light emitting diodes through said one or more data interface units and said one or more LED driving circuits; and each of said chandelier bulbs comprising optical components including one or more of a lens, a diffuser, and a reflector, wherein said optical components are disposed above said light emitting diodes, and wherein said optical components reflect, diffuse, and bend light emitted by said light emitting diodes to create a sparkling appearance that mimics effects similar to a traditional chandelier light bulb having tungsten filaments.

17. The chandelier of claim 16, wherein the power supply is AC power and further comprising a converter for converting the AC power to DC power.

18. The chandelier of claim 17, further comprising a data interface unit that receives signals from the controller, the data interface unit being connected to the driving circuit.

19. The chandelier of claim 18, further comprising a plurality of data interface units and a plurality of driving units, each of the plurality of data interface units receiving signals from the controller, each data interface unit being connected to each driving circuit, and wherein each bulb is connected to at least one driving unit and at least one data interface unit.

20. The chandelier of claim 16, further comprising a transmitter and receiver being connected to the controller for providing signals from the controller to the data interface.

21. The chandelier lamp of claim 16, wherein a housing is disposed on top of said chandelier lamp, wherein said power supply is disposed inside said housing, wherein said controller is integrated with said data interface units and also disposed inside said housing, wherein said one or more LED driving circuits are also disposed inside said housing, wherein said chandelier bulbs comprise cylindrical metal posts to dissipate heat generated by said light emitting diodes inside said chandelier bulbs, wherein said metal posts are in direct contact with a metal base of said LED chandelier light bulbs, wherein each of said chandelier bulbs are driven by an individual LED driving circuit, wherein said each LED driving circuit is communicatively coupled with said controller integrated with said data interface units, and wherein said individual LED driving circuits are connected by wires to said chandelier bulbs.

22. The chandelier lamp of claim 16, wherein a housing is disposed on top of said chandelier lamp, wherein said power supply is disposed inside said housing, wherein said controller is integrated with said data interface unit and said LED driving circuit and also disposed inside said housing, wherein said chandelier bulbs comprise cylindrical metal posts to dissipate heat generated by said light emitting diodes inside said chandelier bulbs, wherein said metal posts are in direct contact with a metal base of said LED chandelier light bulbs, wherein said chandelier bulbs are all connected in parallel and are driven by a single LED driving circuit integrated with said data interface unit and said controller, and wherein said LED driving circuits are connected by wires to said chandelier bulbs.

23. The chandelier lamp of claim 16, wherein a housing is disposed on top of said chandelier lamp, wherein said power supply and said controller are disposed inside said housing, wherein said chandelier bulbs comprise cylindrical metal posts to dissipate heat generated by said light emitting diodes inside said chandelier bulbs, wherein said metal posts are in direct contact with a metal base of said LED chandelier light bulbs, wherein an individual LED driving circuit and an individual data interface unit are integrated with each of said chandelier bulbs, wherein said controller includes a radiofrequency wireless device to communicate with one or more of said data interface and said LED driving circuits integrated with said chandelier bulbs, and wherein said controller wirelessly controls said at least three light emitting diodes to provide said decorative lighting effect.

24. The chandelier lamp of claim 23, wherein a housing is disposed on top of said chandelier lamp, wherein said power supply and said controller are disposed inside said housing, wherein said chandelier bulbs comprise cylindrical metal posts to dissipate heat generated by said light emitting diodes inside said chandelier bulbs, wherein said metal posts are in direct contact with a metal base of said LED chandelier light bulbs, wherein an individual LED driving circuit and an individual data interface unit are integrated with each of said chandelier bulbs, wherein said controller includes a radiofrequency wireless device to communicate with one or more of said data interface and said LED driving circuits integrated with said chandelier bulbs, wherein a set of external LED lights are provided distant from said chandelier lamp, wherein said set of external LED lights is in wireless communication with said controller, and wherein said set of external LED lights dynamically participate with said chandelier lamp to provide said decorative lighting effect, and wherein said controller wirelessly controls said at least three light emitting diodes inside said chandelier bulbs and also wirelessly controls simultaneously said set of external LED lights to provide said decorative lighting effect.

25. The chandelier lamp of claim 23, wherein a housing is disposed on top of said chandelier lamp, wherein said power supply and said controller are disposed inside said housing, wherein said chandelier bulbs comprise cylindrical metal posts to dissipate heat generated by said light emitting diodes inside said chandelier bulbs, wherein said metal posts are in direct contact with a metal base of said LED chandelier light bulbs, wherein an individual LED driving circuit and an individual data interface unit are integrated with each of said chandelier bulbs, wherein said controller includes a radiofrequency wireless device to communicate with one or more of said data interface and said LED driving circuits integrated with said chandelier bulbs, wherein said controller wirelessly controls said at least three light emitting diodes, and wherein said chandelier lamp further includes an audio sensing device operatively connected to a wireless device to provide one or more control signals to said controller, wherein said audio sensing device senses the music that is played in a vicinity of said chandelier lamp and interacts with said controller to create lighting effects according to sound levels and frequencies, thereby creating lighting shows that respond to music that is being played.

26. The chandelier lamp of claim 23, wherein a housing is disposed on top of said chandelier lamp, wherein said power supply, and said controller are disposed inside said housing, wherein said chandelier bulbs comprise cylindrical metal posts to dissipate heat generated by said light emitting diodes inside said chandelier bulbs, wherein said metal posts are in direct contact with a metal base of said LED chandelier light bulbs, wherein an individual LED driving circuit and an individual data interface unit are integrated with each of said chandelier bulbs, wherein said controller includes a radiofrequency wireless device to communicate with one or more of said data interface and said LED driving circuits integrated with said chandelier bulbs, wherein said controller wirelessly controls said at least three light emitting diodes, and wherein said chandelier lamp further includes a brightness sensing device integrated with said controller, wherein said brightness sensing device detects brightness of environment near said chandelier lamp and automatically issues an instruction command to said controller to control dimming of said chandelier bulb.

27. The chandelier lamp of claim 16, wherein a housing is disposed on top of said chandelier lamp, wherein an AC input is disposed in said housing, wherein said chandelier bulbs comprise cylindrical metal posts to dissipate heat generated by said light emitting diodes inside said chandelier bulbs, wherein said metal posts are in direct contact with a metal base of said LED chandelier light bulbs, wherein an individual AC/DC power supply, an individual LED driving circuit, and an individual data interface unit are integrated with each of said chandelier bulbs, wherein said controller is located distant from said chandelier lamp, wherein said controller includes a radiofrequency wireless device to communicate with said data interface units and said LED driving circuits integrated with said chandelier bulbs, and wherein said controller wirelessly controls said at least three light emitting diodes to provide said decorative lighting effect.

28. The chandelier lamp of claim 16, wherein said controller is controlled by a remote control device.

29. The chandelier lamp of claim 16, wherein lighting effects are pre-programmed inside said controller and said pre-programmed lighting effects are one of selected, updated, and modified by one of a wired and a wireless communication protocol, wherein said wireless communication protocol comprises one of a ZigBee, an Infrared, a Bluetooth, and an IEEE 802-11 communication protocol.

* * * * *